United States Patent [19]

Walker et al.

[11] 4,142,927

[45] Mar. 6, 1979

[54] FREE RADICAL EXPLOSIVE COMPOSITION

[76] Inventors: Franklin E. Walker, 15 Way Points Rd., Danville, Calif. 94526; Richard J. Wasley, 4290 Colgate Way, Livermore, Calif. 94550

[21] Appl. No.: 610,166

[22] Filed: Sep. 4, 1975

[51] Int. Cl.[2] ..... C06B 45/10; C06B 25/34; C06B 25/32; C06B 25/04

[52] U.S. Cl. ..... 149/194; 149/92; 149/93; 149/105

[58] Field of Search ..... 149/105, 38, 108.8, 149/81, 92, 93, 107, 19.9, 19.4

[56] References Cited

U.S. PATENT DOCUMENTS

| | | | |
|---|---|---|---|
| 3,417,153 | 12/1968 | Gray | 149/105 |
| 3,759,765 | 9/1973 | Young | 149/38 |
| 3,894,894 | 7/1975 | Elrick | 149/38 |

*Primary Examiner*—Samuel W. Engle
*Assistant Examiner*—Donald P. Walsh
*Attorney, Agent, or Firm*—Michael D. Nelson

[57] ABSTRACT

An improved explosive composition is disclosed and comprises a major portion of an explosive having a detonation velocity between about 1500 and 10,000 meters per second and a minor amount of a getter additive comprising a compound or mixture of compounds capable of capturing or deactivating free radicals or ions under mechanical or electrical shock conditions and which is not an explosive. Exemplary getter additives are isocyanates, olefins and iodine.

11 Claims, No Drawings

FREE RADICAL EXPLOSIVE COMPOSITION

BACKGROUND OF THE INVENTION

This invention relates to modifying the explosion performance characteristics of an explosive by doping the explosive with a free radical or ion getter. Typical explosion performance characteristics which may be modified include initiation sensitivity, detonation velocity, brisance, etc. It is believed that under ideal conditions, a typical explosion follows the path shown below:

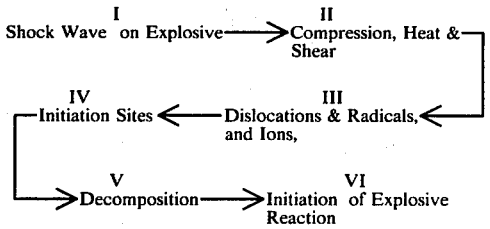

In the first step (I) a shock wave is applied to the explosive either by a mechanical, vibrational, thermal, or electrical shock. The non-explosive getter additive of the present invention can increase the amount of shock necessary to initiate the explosion. This is important in formulating explosives since it allows the use of more powerful explosives in conventional applications where the explosives were previously too sensitive.

In the second step (II) the explosive undergoes compression, heat and shear caused from the shock wave. The third step (III) is the generation of free radicals and/or ions. The doping of the explosive with a compound which will capture or deactivate free radicals or ions, the number of initiation sites can be controlled. The number of initiation sites (Step IV) affects the rate of detonation. Thus by using the additives of this invention the detonation velocity and brisance can be modified.

The fifth step (V) is the decomposition of the explosive. This decomposition is a function of time and number of initiation sites. Since the number of initiation sites can be varied by the presence of the additive of this invention, and since the number of initiation sites has an effect upon the number of molecular decompositions, the decomposition time can also be modified by the use of the additives of this invention.

The sixth step (VI) is the explosive reaction yielding the high energy release. This explosive reaction is a function of the critical initiation energy of the explosive (See UCRL-75722, Apr. 21, 1975, Lawrence Livermore Laboratory Report by F. E. Walker and R. J. Wasley). The explosive reaction can also be modified by proper selection of the additive of this invention.

It is an object of this invention to provide an additive which when added to an explosive modifies the explosion performance characteristics.

It is an additional object of this invention to provide an improved explosive.

It is a further object of this invention to provide a method for modifying the explosion characteristics of an explosive.

Other additional and further objects will become apparent from the following description of the invention and accompanying claims.

SUMMARY OF THE INVENTION

The aforegoing objects and their attendant advantages can be realized by incorporating into a major portion of an explosive, which is capable of being detonated by a mechanical or electrical shock, a minor portion of a getter additive comprising a compound or mixture of compounds capable of capturing or deactivating free radicals or ions under mechanical or electrical shock conditions but which is not an explosive by itself. Exemplary classes of compounds include organic isocyanates, olefins and iodine.

We have discovered the explosion performance characteristics, i.e., initiation sensitivity, detonation velocity, brisance, etc., of an explosive can be conveniently modified by the use of the non-explosive getter additives of this invention. It is well known that the initiation sensitivity of an explosive is effectively decreased by the addition of a non-explosive diluent. Explosives which detonate under a given set of conditions will generally be less sensitive to detonation upon dilution. The additives of this invention reduce the initiation sensitivity considerably beyond that reduction which would be expected by dilution.

Although not wising to be bound bo the theory, it is believed that the additives of this invention capture or deactivate free radicals or ions under shock conditions and depress the initiation of the explosive reaction. Regardless of the theory or mechanism involved, we have found that the inclusion of the getter additives of this invention to an explosive significantly affects the explosion performance characteristics.

Explosives

Explosives which may be used in the practice of this invention are metastable chemical compounds that are capable of releasing their chemical energy explosively, i.e., in a very short time, from a mechanical or electrical shock. As referred to herein "mechanical shock" means any sudden change of pressure on the explosive or shearing of the explosive such as occurs from compression by a hammer or the sudden cutting of the explosive with a sharp blade, or by a vibration, etc. The explosives which may be employed typically have a detonation velocity ranging from 1,500 to 10,000 meters per second and more usually from 2500 to 9,000 meters per second. Exemplary explosives which may be employed include the nitro aromatic compounds such as trinitrobenzene(TNB), triaminotrinitrobenzene(TATB), diaminotrinitrobenzene(DATB), trinitrotolune(TNT), trinitroanisole, trinitrocresol, trinitrophenol (picric acid), trinitrophenetol, trinitroresorcinol, trinitromethylaniline, diazodinitrophenyl, hexanitrodiphenylamine, hexanitrodiphenyl, diazodinitrophenol, hexanitrodiphenyl sulfide, hexanitrostilbene(HNS), hexanitrodiphenyl sulfine, hexanitroazobenzene, picryl sulfone, ammonium picrate, guanidine picrate, benzotrisoxadiazole trioxide, etc.; the nitramines such as cyclotrimethylenetrinitramine(RDX), trinitrophenylmethylnitramine(Tetryl), cyclotetramethylenetetranitramine(HMX), ethylenedinitramine, nitroguanidine, etc.; the nitrosamines such as cyclotrimethylenetrinitrosamine, cyclotetramethylenetetranitrosamine, nitrosoguanidine, etc.; the nitric acid esters such as pentaerythritol tetranitrate(PETN), diethanolnitramine dinitrate, nitromannite, nitrostarch, propanetriol trinitrate, diethyleneglycol dinitrate(DEGN), nitrocellulose, nitroisobutyl glycerine trinitrate, tetranitrodiglycerine, nitroglycol, nitrosugars, glycerine chlorhydrin dinitrate, trimethylolethane trinitrate, nitroglycerine, etc.; other nitro compounds such as tetranitro-2,3,5,6-dibenzo-1,3a,4,6a-tetraazapentalene(TACOT), bis trinitroethyladipate, dinitropropyl acrylate, ethyldinitropentanoate, bis(fluorodinitroethyl)formal, tetranitromethane, nitromethane, amatols, Amatex, etc.; the inorganic nitrates such as ammonium nitrate, barium nitrate, Baratol, potassium nitrate, lead nitrate, etc.; the inorganic azides such as lead azide, silver azide, copper azide, lead dinitrophenylazide, etc.; and other explosives such as lead styphnate, mercury fulminate, lead picrate, lead salts of dinitrosalicylic acid, tetrazene, lead hypophosphite, etc.

The explosives may be in the form of solids, liquids, or gases. They may be used in combinations such as RDX and TNT or individually. Also, liquid explosives may be mixed with solid explosives or gaseous explosives and vise-versa.

Typical detonation velocities are shown in the following table.

TABLE I

TYPICAL DETONATION VELOCITIES

| Explosive | Velocity (m/sec) |
|---|---|
| Baratol | 4800 |
| Nitrocellulose (13.45%N) | 7300 |
| Nitroglycerine | 7700 |
| Ammonium Nitrate | 4100 |
| Trinitrotoluene(TNT) | 6930 |
| Picric Acid | 7000 |
| Mercury fulminate | 3920 |
| Tetryl | 7850 |
| Ammonium picrate | 6500 |
| Lead Azide | 5000 |
| HMX | 9100 |
| RDX | 8700 |
| Diaminotrinitrobenzene | 7520 |
| Pentaerythritol tetranitrate | 8260 |

Getter Additives

The getter additives which may be employed in the practice of this invention are compounds either organic or inorganic which are capable of capturing or deactivating free radicals or ions under mechanical or electrical shock conditions but which are not explosives. The high molecular weight compounds are preferred such as those having molecular weights between about 125 and 800 and more preferably from 150 to 500. The compounds will have the ability to accept or capture low molecular weight free radicals or ions. Depending upon the desired properties, a donor additive capable of capturing more than one free radical and/or ion can be highly advantageous. Getter additives which may be employed to vary the explosion performance characteristics include the following:

I. Isocyanates having from 4 to 32 carbons and preferably having at least one carbon-carbon chain longer than 4 carbons and preferably longer than 6 carbons. The isocyanates which may be employed generally have the following formula:

$$OCN—R—(—NCO)_x(—H)_y$$

Wherein:

R is a hydrocarblene having from 2 to 30 carbons, preferably from 4 to 15 carbons and more preferably having from 6 to 12 carbons;

x is an integer equal to 0 or 1, preferably 1; and y is an integer equal to 0 when x is 1 and equal to 1 when x is 0.

As referred to herein hydrocarbylene is a divalent radical composed mostly of hydrogen and carbon and may be aliphatic, alicyclic, aromatic or combinations thereof, e.g., alkylarylene, aralkylene, arylene, alkylene, alkylcycloalkylene, cycloalkylarylene, etc., and may be saturated or unsaturated. Exemplary isocyanates which may be employed are monoisocyanates such as hexylisocyanate, decylisocyanate, dodecylisocyanate phenylisocyanate, tolylisocyanate, cyclohexylisocyanate, xyleneisocyanate, cumeneisocyanate, abietylisocyanate, etc; diisocyanates such as hexanediisocyanate, decanediisocyanate, octadecanediisocyanate, phenylenediisocyanate, tolylenediisocyanate, bis(diphenylisocyanate), methylene bis(phenylisocyanate), bis(phenylisocyanate) sulfide, etc.

Various functional groups may be present on or in the hydrocarbylene chain and may be halo, carbonyl, amido, oxy, alkoxy, epoxy, carboxy, carboxyl, sulfoxy, sulfonyl, sulfino, sulfo, etc.

II. Olefins having from 2 to 30 carbons and preferably having from 4 to 20 carbons. The olefins may have multiple olefinic bonds and may be conjugated or nonconjugated. Exemplary olefins include, ethylene, propylene, butene, isobutene, isoprene, isopentene, cyclohexene, pentadiene, hexadiene, decene, dodecene, octadecene, octadecadiene, phenylpropene, diphenylpropene, etc.

III. Iodine.

Preparation

The composition of this invention can be prepared by simple admixture of the explosive and the getter additive. The getter additive may be solid, liquid or gaseous. In the event of a solid, the getter additive should preferably be pulverized or otherwise rendered into a powder form and intimately mixed with the explosive. The explosive-additive mixture may then be used directly or slurried, pressed, cast, gelled, extruded, plasticized, pelletized, etc. In one embodiment of the invention, the getter additive is admixed with only a portion of the explosive. It should be recognized that many methods of preparation and design may be utilized within the scope of the present invention.

In the event the getter additive is a liquid, it can be incorporated into the explosive in the same manner as discussed above. If the explosive is a solid, then a paste or slurry of the explosive and getter additive may be made. If the explosive is also a liquid, the two may be used as a liquid mixture or incorporated onto a solid support. Alternatively, the mixture may be thickened into a gel. In still another embodiment, the mixture is polymerized into a polymeric matrix. In this embodiment it may be necessary with some of the additives to add them after polymerization.

In the event the getter additive is a gas, the explosive may be used in the gaseous state. Alternatively, the getter additive may be dissolved in a carrier liquid or in the explosive. In still another embodiment, a gas precursor may be employed which releases the gaseous getter additive prior to use or detonation.

The amount of getter additive which may be employed in the practice of this invention can vary over a wide range depending upon the type of explosives involved, the type of getter additives selected, etc. Generally, however, the getter additive will be present in an amount from 0.01 to 20 percent by weight of the final explosive and preferably will be present in an amount from 0.2 to 5 weight percent.

The weight ratio of getter additive to explosive will generally vary from 0.01 to 20 weight parts of getter additive for each 100 weight parts of explosive and preferably from 0.2 to 10 weight parts of getter additive for each 100 weight parts of explosive.

It should be recognized that precursors of the getter additives may be prepared and added to the explosive and such precursors are included within the scope and spirit of this invention. It is also recognized that compounds other than the classes specifically set forth in the specification may be employed provided that such compounds are capable of capturing free radicals or ions under shock conditions and are not explosives themselves. An additive is classified as a non-explosive if it cannot be exploded by a mechanical shock and has a detonation velocity below 1500 meters per second. A mechanical shock is defined as that which transfers not less than 2500 cal/cm$^2$ of energy fluence.

Other Additives

In addition to the getter additive of this invention, other additives may be present without adversely affecting the getter's performance properties. Exemplary additives include oxidizers such as metallic nitrates e.g., sodium, and potassium nitrate, etc.; swelling agents such as guar flour, cellulose, carboxymethyl cellulose, etc.; powdered metals such as aluminum, magnesium, zirconium, titanium, etc.; polymers such as vinyl, acrylic and alkylene oxide polymers, PVA, polyacrylamide, etc.; alkali metal azides such as sodium and potassium azide, etc.; water; carbonaceous materials such as powdered coal, fuel oil, coal dust, charcoal, wood meal, etc.; glass powder and others.

The amount of other additives which may be employed may vary over a wide range depending upon the type of additive selected, the purpose, the type of explosive, etc. Generally, however, the other additives will be present in an amount varying from 0 to 60 percent but usually varying from 0.1 to 30 percent and more usually varying from 1 to 20 percent by weight of the total composition.

Uses

The explosive compositions of this invention can be used in a wide variety of applications. They may be used in typical demolition and blasting activities, in well fracturing (See U.S. Pat. No. 3,825,452), in making molded explosives of varying detonation speeds (See U.S. Pat. No. 3,619,306), in generating gases such as nitrogen for use in dynamic lasers (See U.S. Pat. No. 3,773,947), or for use in automobile crash bags (See U.S. Pat. No. 3,785,674), in making rocket fuels (See U.S. Pat. No. 3,804,683), in making ammunition (See U.S. Pat. No. 2,111,203), in making fuses (See U.S. Pat. No. 3,421,441), in welding (See U.S. Pat. No. 367,234), in bombs and many other applications.

The composition of this invention may also be employed in making armor-piercing bombs and rockets.

The following examples are presented to illustrate the practice of specific embodiments of this invention and should not be interpreted as limitations upon the scope of the invention.

EXAMPLE 1

This example is presented to illustrate the initiation sensitivity of an explosive. In this test, a compression wave of varying strengths is applied to a sample explosive by impacting a weight against the sample until the explosive detonates (explodes).

This test is typically called the drop hammer test. The drop hammer test is more fully described in the Manual For Sensitiveness Tests, TTCP Panel 0–2, February 1966, Canadian Armanent Research and Development Report, which is herein incorporated by reference. Briefly, a 2.5 kilogram hammer is guided to various heights above a 1⅛ inch diameter 10 inch high cylindrical steel striking pin (weight is 2.5 kilograms). The striking pin rests on the sample explosive which in turn rests on a hardened steel anvil.

The test sample of approximately 35 mg. is placed on 80–100 mesh sand paper which rests on the anvil and the striking pin is gently pressed down upon the sample. The hammer is dropped from a given height onto the striking pin. If no explosion occurs, the test is repeated with a fresh sample from successively greated heights until an explosion occurs. If an explosion occurs, a fresh sample is replaced in the test machine and tested at successively lower heights until a point of no explosion is reached. Thereafter, a sample is tested at a given increment below the level at which the previous sample was tested if that sample exploded, and at a given increment above the level which the previous one was tested if it did not explode. By using this up-and-down method and analyzing the data statistically, a height for 50% ignition probability is attained. The procedure for determining this height and the error at a 95% confidence level is discussed by W. J. Dixon and A. M. Mood, "Method of Obtaining and Analyzing Sensitivity Data," *Journal American Stat. Assoc.*, Vol. 43, 1948, pp109–126, which is herein incorporated by reference.

A microphone is mounted on the anvil face and the signal from the microphone is fed to an amplifier which in turn triggers a thyratron tube. Triggering the thyratron tube lights a neon lamp on the panel. This indicates whether the sample exploded.

The following table illustrates the ignition sensitivity for various commercial explosives.

TABLE II

| | Drop Hammer Height |
|---|---|
| Trinitrotoluene (TNT) | 100 cm. |
| HMX | 39 cm |

EXAMPLE 2

This example illustrates the desensitizing effect of a non-explosive diluent on the ignition sensitivity. An approximate 2 gram portion of TNT is added to a small 50 cc glass bottle and about 100 milligrams of benzoic acid are added. The bottle is tumbled for about 30 minutes to uniformly mix the explosive with the diluent. Thereafter successive 35 milligram portions of the mixture are tested in the drop hammer test. The results show that the addition of 5 percent of a diluent increased the drop hammer height to about 145 cm.

EXAMPLE 3

This example is presented to illustrate that mixtures of explosives do not automatically change the ignition sensitivity. The same procedure as discussed in Example 2 is followed except that 5 percent of HMX is mixed with 95% of TNT and no additives were added. The sample exploded at 100 cm.

EXAMPLE 4

The procedure of Example 2 is repeated except that phthalic anhydride diluent is used instead of benzoic acid. The Sample of 95% TNT and 5% phthalic anhydride exploded at about 145 cm.

EXAMPLE 5

This example is presented to illustrate the reduction in ignition sensitivity by the addition of a non-explosive free radical or ion getter to the explosive. In this test, approximately 2 grams of TNT fine powder are placed in a 50 cc glass bottle along with about 100 milligrams of tolylene diisocyanate. The bottle is tumbled for about 10 minutes to uniformly mix the explosive and the additive. Next, successive 35 mg. portions of the mixture are tested in the drop hammer apparatus. The mixture did not explode even when the highest position on the drop hammer apparatus was used, i.e., 177 cm.

EXAMPLE 6

The procedure of Example 5 is repeated except that azo bis isobutryldiisocyanate is used in place of the tolylene diisocyanate. The explosive mixture exploded at 155 cm.

EXAMPLE 7

The procedure of Example 5 is repeated except that Iodine is used in place of the tolylene diisocyanate and only 40 milligrams was used. The mixture of 98% TNT and 2% of Iodine exploded at 141 cm. TNT with a diluent at 2% is believed to explode at 114 cm according to extrapolation.

TABLE III

| DROP HAMMER TEST | | | |
|---|---|---|---|
| Example | Explosive | Additive | Height (cm) |
| 1. | TNT | none | 100 |
| 2. | TNT | Diluent* | 145 |
| 3. | TNT & HMX | none | 100 |
| 4. | TNT | Diluent** | 145 |
| 5. | TNT | Tolylene Diisocyanate | 177 |
| 6. | TNT | ABID | 155 |
| 7. | TNT | Iodine(2%) | 141 |

*Diluent used was benzoic acid
**Diluent was phthalic anhydride
ABID is azo-bis-isobutyryldiisocyanate

We claim:

1. A composition of matter comprising:

(1) a major portion of a metastable explosive capable of being detonated by a mechanical, thermal or electrical shock and having a detonation velocity from 1,500 to 10,000 meters per second, and (2) from 0.1 to 20 weight percent of a getter additive, or combination of getter additives, which is (i) capable of capturing or deactivating free radicals or ions during the initiation of said explosive, (ii) not an explosive, and (iii) is selected from the group consisting of $C_4$ to $C_{32}$ isocyanates, $C_2$ to $C_{30}$ olefins, iodine, or mixtures thereof.

2. The composition defined in claim 1 wherein said getter additive has a molecular weight between about 125 and 800.

3. The composition defined in claim 1 wherein said getter additive is present in an amount from 0.2 to 5 weight percent.

4. The composition defined in claim 1 wherein said getter is an isocyanate having the formula:

$$OCN—R—(—NCO)_x(—H)_y$$

wherein

R is a hydrocarbylene having from 2 to 30 carbons, x is an integer equal to 0 or 1, and y is an integer equal to 0 when x is 1 and equal to 1 when x is 0.

5. The composition defined in claim 4 wherein x is 1.

6. The composition defined in claim 5 wherein said getter is tolylene diisocyanate.

7. The composition defined in claim 1 wherein said getter is iodine.

8. The composition defined in claim 1 wherein said getter is a diisocyanate.

9. The composition defined in claim 1 wherein said explosive is selected from TNT, RDX, Tetryl, TATB, PETN, DATB, nitroquanidine and DEGN.

10. The composition defined in claim 1 wherein said explosive is TNT and said getter is tolylene diisocyanate.

11. The composition of matter comprising a major portion of a metastable explosive capable of being detonated by a mechanical, electrical or thermal shock and having a detonation velocity of 1,500 to 10,000 meters per second and from 0.01 to 20 weight percent of tolylene diisocyanate.

* * * * *